US009182737B2

(12) United States Patent
Hiramatsu et al.

(10) Patent No.: US 9,182,737 B2
(45) Date of Patent: Nov. 10, 2015

(54) IMAGE FORMING APPARATUS FOR REPLACING TONER FROM THE MAIN BODY OF THE IMAGE FORMING APPARATUS

(75) Inventors: Daisuke Hiramatsu, Numazu (JP); Jun Miyamoto, Mishima (JP); Tsutomu Nishiuwatoko, Numazu (JP); Ken Kikuchi, Mishima (JP); Kensuke Suzuki, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 344 days.

(21) Appl. No.: 13/544,525

(22) Filed: Jul. 9, 2012

(65) Prior Publication Data

US 2013/0016995 A1 Jan. 17, 2013

(30) Foreign Application Priority Data

Jul. 12, 2011 (JP) ..... 2011-153628

(51) Int. Cl.
*G03G 15/08* (2006.01)
*G03G 21/18* (2006.01)
*G03G 21/16* (2006.01)

(52) U.S. Cl.
CPC ..... *G03G 21/1821* (2013.01); *G03G 15/0865* (2013.01); *G03G 21/1676* (2013.01)

(58) Field of Classification Search
USPC ..... 399/119
See application file for complete search history.

(56) References Cited

U.S. PATENT DOCUMENTS

| | | | | |
|---|---|---|---|---|
| 6,115,571 | A * | 9/2000 | Kobayashi | 399/119 |
| 2010/0166453 | A1* | 7/2010 | Okabe | 399/111 |
| 2011/0064469 | A1* | 3/2011 | Itabashi | 399/125 |

FOREIGN PATENT DOCUMENTS

| | | | |
|---|---|---|---|
| JP | 04212176 | A * | 8/1992 |
| JP | 06130808 | A * | 5/1994 |
| JP | 2004-333929 | A | 11/2004 |

OTHER PUBLICATIONS

Translation of JP06-130808A, to Haneda et al. on May 1994.*

* cited by examiner

*Primary Examiner* — Quana M Grainger
(74) *Attorney, Agent, or Firm* — Canon USA Inc. IP Division

(57) ABSTRACT

A toner storage unit provided in an image forming apparatus that enables a user to replace the toner storage unit when the user opens the door of the image forming apparatus, moves a developing cartridge in a direction corresponding to removal of the developing cartridge, and places the developing cartridge in the toner storage unit replacement position where the toner storage unit can be removed and replaced.

18 Claims, 18 Drawing Sheets

IMAGE FORMING APPARATUS FOR REPLACING TONER FROM THE MAIN BODY OF THE IMAGE FORMING APPARATUS

BACKGROUND OF THE INVENTION

1. Field of the Invention

The present invention relates to a developing cartridge in which a toner storage unit (toner cartridge) is removably mounted in a main unit and to an image forming apparatus in which the developing cartridge is removably mounted.

2. Description of the Related Art

Conventionally, in an image forming apparatus (electrophotographic image forming apparatus) that uses the electrophotographic image forming process, cartridge systems have been used to allow the process unit in the apparatus main body of the image forming apparatus (apparatus main body) to be replaced as one unit.

One cartridge system is a developing cartridge in which a developing device, such as a developing roller, is provided in the cartridge. Another cartridge system is a process cartridge in which the electrophotographic photosensitive drum and the process unit, which acts on the electrophotographic photosensitive drum, are integrated into a cartridge as one unit. A process cartridge may also be provided with a photosensitive member in a developing cartridge having a developing roller that works as the process unit.

Still another cartridge system is a toner cartridge system that is removably provided, with a toner storage unit that stores toner, in a developing cartridge. The toner cartridge system allows the user to replace the toner storage unit independently of the other parts that configure the developing cartridge such as the photosensitive drum and developing roller.

Therefore, the toner cartridge system is advantageous when the consumption cycle of toner stored in the toner storage unit differs from the product lifetime of the other parts configuring the developing cartridge such as a photosensitive drum and a developing roller.

According to the image forming apparatus discussed in Japanese Patent Application Laid-Open No. 2004-333929, a user who wants to replace the toner cartridge opens a door of the image forming apparatus provided for replacing toner cartridge and replaces the toner cartridge. This configuration allows the user to replace the toner cartridge without having to take the main unit of the developing cartridge out of the image forming apparatus.

The image forming apparatus in the above-described art requires that the door for replacing the toner storage unit is separate from the door for replacing the main unit of the developing cartridge. Therefore, when the image forming apparatus in the art is compared with an image forming apparatus where the same door is used for replacing both the main unit of the developing cartridge and the toner storage unit, several differences becomes apparent.

The use of multiple doors requires an increase in the number of parts for the image forming apparatus. More specifically, additional doors result in an increase in door bodies, hinge axes of the doors, and door handles. The use of multiple doors also results in a decrease in the strength of the main body of the image forming apparatus. That is, the more holes bored on the side-plate of the image forming apparatus for providing door openings, the weaker the strength of the side-plate becomes.

SUMMARY OF THE INVENTION

An aspect of the present invention is directed to an image forming apparatus that allows the user to replace a toner storage unit without having to taking out the main unit of the developing cartridge from an apparatus main body of the image forming apparatus. In addition, the image forming replacing the toner storage unit is made easier and, at the same time, allows the door for replacing the developing cartridge to also be used for replacing the toner storage unit.

According to an aspect of the present invention, an image forming apparatus includes an apparatus main body, and a developing cartridge removable mounted in the apparatus main body, wherein the developing cartridge includes a main unit, wherein the main unit includes a developer bearing member for forming a toner image, and a toner storage unit removably mounted in the main unit, wherein the toner storage unit is configured to supply a developer to the developer bearing member, wherein the apparatus main body includes a guide portion configured to guide a guided portion of the developing cartridge so that the developing cartridge can move between a mounting position and a replacement position, wherein the mounting position is a position in which the developing cartridge forms an image, and wherein the replacement position is a position downstream of the mounting position in a direction the developing cartridge is removed and at which position the toner storage unit can be removed from the main unit, wherein the developing cartridge can be removed from the apparatus main body via an opening provided on the apparatus main body, and wherein, in a state in which the guided portion is supported by the guide portion in the replacement position, the toner storage unit can be removed from the developing cartridge in a direction the toner storage unit is removed, which is different from the direction the developing cartridge is removed, wherein the toner storage unit can removed from the apparatus main body via the opening.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

It should be noted that the scope of the present invention is not limited to the sizes, materials, shapes, and relative arrangement of the components described in the exemplary embodiments unless otherwise described.

Figure 1A:
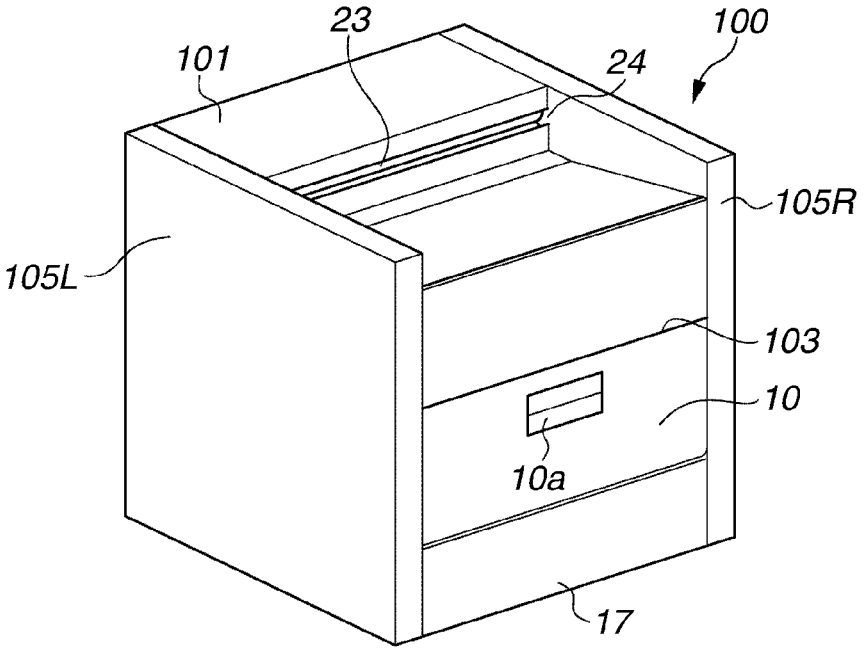
FIG. 1A is a perspective view of an image forming apparatus according to a first exemplary embodiment.
Figure 1B:
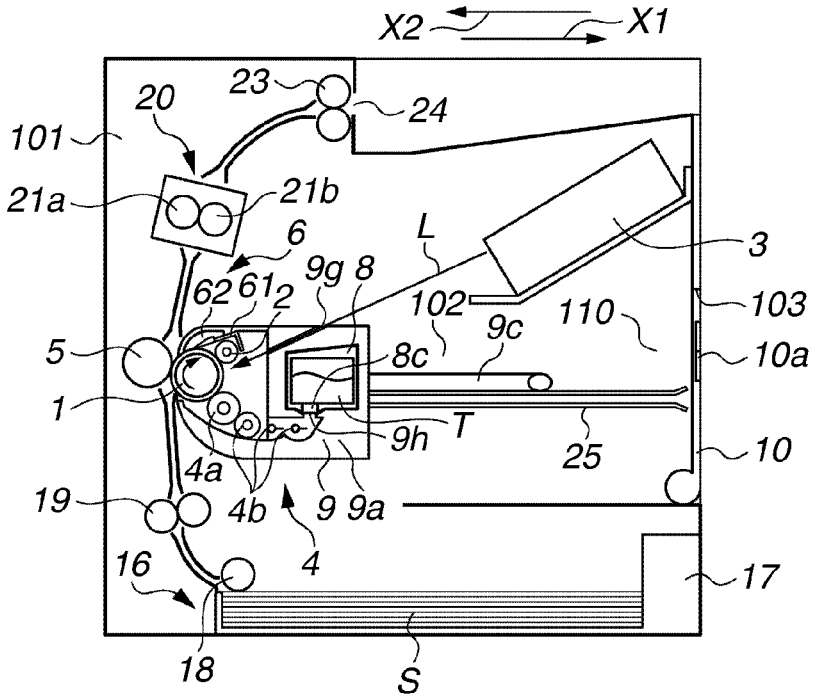
FIG. 1B is a configuration diagram of the image forming apparatus according to the first exemplary embodiment.

FIGS. 1A and 1B are diagrams illustrating an external perspective view and a general configuration of an image forming apparatus 100 according to a first exemplary embodiment of the present invention. The image forming apparatus 100 is a monochrome laser printer that uses the electrophotographic process. That is, the image forming apparatus 100 forms an image on a sheet-like recording medium s based on an electrical image signal transmitted from the host apparatus (not illustrated) such as a personal computer, an image reader, or a facsimile apparatus on the other end of the line to a control circuit (not illustrated).

In the description below, an anterior side or a front side of the image forming apparatus 100 is the side on which a door 10 for opening/closing the apparatus is provided. A rear side is the side opposite to the front side. The front-to-rear direction is the direction from the rear side to the front side of the image forming apparatus (front direction) and the direction opposite to the front direction (rear direction). A left and a right are the left and the right of the image forming apparatus, respectively, when it is viewed from the front side. The left-right direction is the direction from the right to the left (left direction) and the direction opposite to the left direction (right direction). An apparatus main body 101 (main body of the image forming apparatus) is the main body part of the image forming apparatus except a developing cartridge 9.

A drum 1 is provided approximately in the center of the apparatus main body 101. A charging unit, an image exposure unit, a developing unit 4, a transfer unit, and a drum cleaning unit 6 are provided around the drum 1 as the process unit that acts on the drum.

The drum 1 is an electrophotographic photosensitive member (electrophotographic photosensitive drum) that works as an image bearing member on which a latent image is formed. The drum 1, to which the driving force is transmitted from the drive transmission unit (not illustrated), is rotatably driven clockwise, as indicated by the arrow, at a predetermined speed. In the present exemplary embodiment, the drum 1, the charging unit, a developing roller (developer bearing member) 4*a*, a developer conveying unit 4*b*, a cleaning blade 61, and a cleaner container 62 are integrated into one unit as a main unit 9*a*. The developing cartridge 9 in the present exemplary embodiment, with the configuration in which the main unit 9*a* and a toner storage unit 8 are integrated, is removably mounted in a developing cartridge attaching/detaching portion 102 of the apparatus main body 101. The main unit 9*a* alone can also be removably mounted in the apparatus main body 101 with the toner storage unit 8 removed therefrom. The charging unit is a charging roller 2. The charging roller 2, which is substantially in parallel to and abuts on the drum 1, rotates according to the rotation of the drum 1. With a predetermined charging bias voltage being applied from a power supply (not illustrated) to the charging roller 2, the surface of the drum 1 is uniformly charged to a predetermined polarity and potential.

The image exposure unit, which is a laser scanner unit 3, is provided in the upper-right direction of the drum 1 in FIG. 1B. The unit 3 outputs a laser beam L, corresponding to image information transmitted from the host apparatus to the control circuit, to scan and expose a charging processing surface of the drum 1 thereto. This operation forms an electrostatic latent image, corresponding to the scanned and exposed pattern, on the surface of the drum 1. At this time, the laser beam L passes through a developing cartridge exposure hole 9*g*.

The developing unit 4 includes the developing roller 4*a* and the developer conveying unit 4*b*. The rotatable developer conveying unit 4*b*, which is a unit for conveying the developer T, conveys the developer T supplied from the toner storage unit 8 via a toner supply hole 9*f*, in a direction in which the developing roller 4*a* is provided. As a result, the developer T adheres to the developing roller 4*a*. In addition, the developer T adheres from the developing roller 4*a* to the surface of the photosensitive drum 1, with the result that the developer T is transferred from the developing roller 4*a* to the surface of the photosensitive drum 1 according to the electrostatic latent image. This sequence of operation causes the electrostatic latent image to be developed into a developer image (toner image).

The transfer unit includes a transfer roller 5. The transfer roller 5 applies a voltage with a reversed attribute to that of the developer T, causing the toner image to be transferred to the recording medium S.

The drum cleaning unit 6 includes the cleaning blade 61 and the cleaner container 62. The cleaning blade 61 removes the developer T remaining on the drum 1. After that, the developer T removed from the surface of the drum 1 is recovered into the cleaner container 62 in the developing cartridge 9.

Upon receiving the image formation start signal, the control circuit unit drives the main motor (not illustrated), causing the drum 1 to be rotated at a predetermined speed. A predetermined charging bias is applied to the charging roller 2, causing the surface of the rotating drum 1 to be uniformly charged to a predetermined polarity and potential. The laser beam L, modulated corresponding to the image signal, is output from the laser scanner unit 3 to scan and expose the drum surface thereto. The scan and expose operation forms an electrostatic latent image, corresponding to a monochrome image, on the drum surface. The developing roller 4*a* controlled to perform the developing operation develops the electrostatic latent image as a monochrome image (toner image).

On the other hand, a paper feeding roller 18 of a paper feeding unit 16 is driven at a predetermined control timing to separate and feed one sheet of recording medium S from a paper feeding cassette 17 in which sheet-like recording medium S is stacked for storage. The user can pull out and push in the paper feeding cassette 17 on the front side of the apparatus main body 101 (front loading). The fed recording medium S is introduced into a transfer nip portion, which is a contact point of the transfer roller 5 and the drum 1, by a registration roller pair 19 at a predetermined control timing. The transfer bias is applied from the power supply unit (not illustrated) to the transfer roller 5. The transfer bias has the predetermined potential and the polarity opposite to the charging polarity of the developer T. The transfer bias, when applied, causes the toner image on the drum 1 to be transferred onto the surface of the recording medium S while the recording medium S is nipped and conveyed through the transfer nip portion.

The recording medium S is separated from the surface of the photosensitive drum 1 and introduced into a fixing unit 20. The fixing unit 20 fixes the transferred toner image onto the recording medium S. The fixing unit 20 includes a rotating heating roller 21*b* and a pressure roller 21*a*. The pressure roller 21*a* pressure-contacts with the heating roller 21*b* to apply heat and pressure to the recording medium S. That is, the recording medium S, on which the toner image on the drum 1 is transferred, is conveyed by the fixing roller pair 21*a* and 21*b* while the recording medium S passes through the fixing unit 20. Heat and pressure are applied to the recording medium S by the fixing roller pair 21*a* and 21*b* to fix the toner image on the surface of the recording medium S. After that, the recording medium S is output from the fixing unit 20 and, by a discharging roller pair 23, discharged outside of the apparatus main body 101 via a discharging unit 24 as an image-formed product. The position of the developing cartridge 9 in the apparatus main body 101 when an image is formed is called the mounting position.

The user moves the developing cartridge 9 when the user newly mounts the developing cartridge 9 in the apparatus main body 101, takes out the developing cartridge 9 from the apparatus main body 101, or moves the developing cartridge 9 to a toner storage unit replacement position 110 to replace the toner storage unit 8.

To increase usability, the image forming apparatus 100 according to the present exemplary embodiment provides the front-access replacement method for mounting, taking out, or moving the developing cartridge 9.

The front access replacement method will be described in detail below. An opening 103, through which the developing cartridge 9 is inserted or removed, is provided on the front side of the apparatus main body 101 so that the user can insert the developing cartridge 9 into the developing cartridge attaching/detaching portion 102 or take out the developing cartridge 9 from the apparatus main body 101. The door 10 is provided as an opening/closing member that can move between the closing position at which the opening 103 is closed, and the opening position at which the opening 103 is opened. In the present exemplary embodiment, the door 10 is turned with respect to the apparatus main body 101 around the horizontal axis (hinge axis) (not illustrated) on the bottom side of the door so that the door 10 can be opened and closed. Therefore, the user can turn the door 10 upward around the hinge axis so that the door 10 fits into the opening 103 of the apparatus main body 101 as illustrated in FIGS. 1A and 1B. When the door 10 is closed in this manner, the opening 103 is closed.

Figure 2:
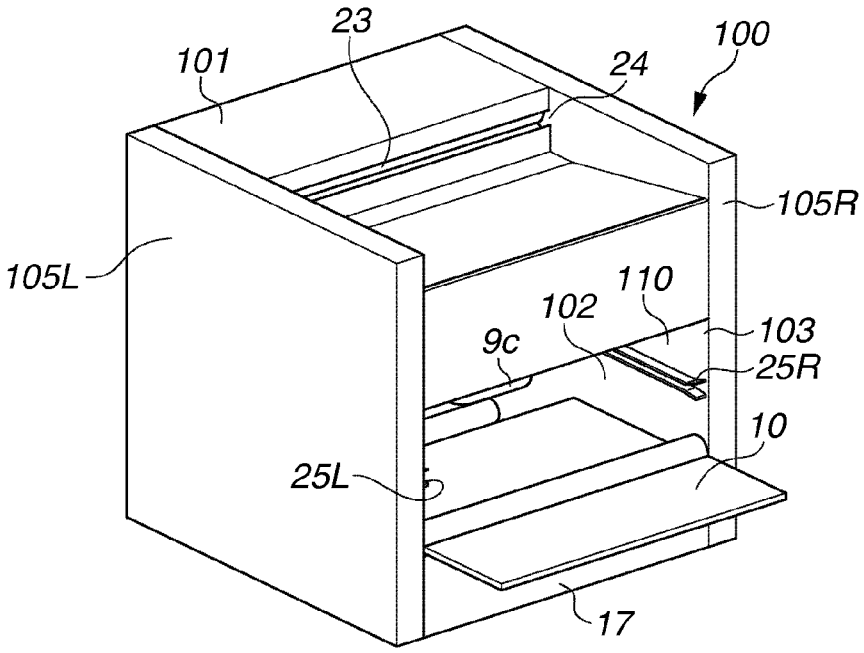
FIG. 2 is a perspective view of the image forming apparatus according to the first exemplary embodiment with the door opened.

On the other hand, the user can turn the door 10 downward around the hinge axis into the direction of the front side of the apparatus main body 101 so that the door 10 is opened on the apparatus main body 101 as illustrated in FIG. 2. Thus, the opening 103 on the front side of the apparatus main body is opened. The door 10 has a pull 10*a*. The user uses the pull 10*a* to open the door 10 to open up the developing cartridge attaching/detaching portion 102. In this state, a handle 9*c* on the developing cartridge 9 provided on the developing cartridge attaching/detaching portion 102 is exposed and can be seen from the opening 103 as illustrated in FIG. 2. The image forming apparatus 100 does not operate with the door 10 opened.

In the developing cartridge attaching/detaching portion 102, developing cartridge attaching/detaching guide portions (guide portion) 25 are provided on the inside wall of the frames 105R and 105L of the apparatus main body 101 to guide the attachment/detachment of the developing cartridge 9. A right-side guide portion 25R and a left-side guide portion 25L, which are opposed to each other, are provided as the guide portion 25.

Figure 3A:
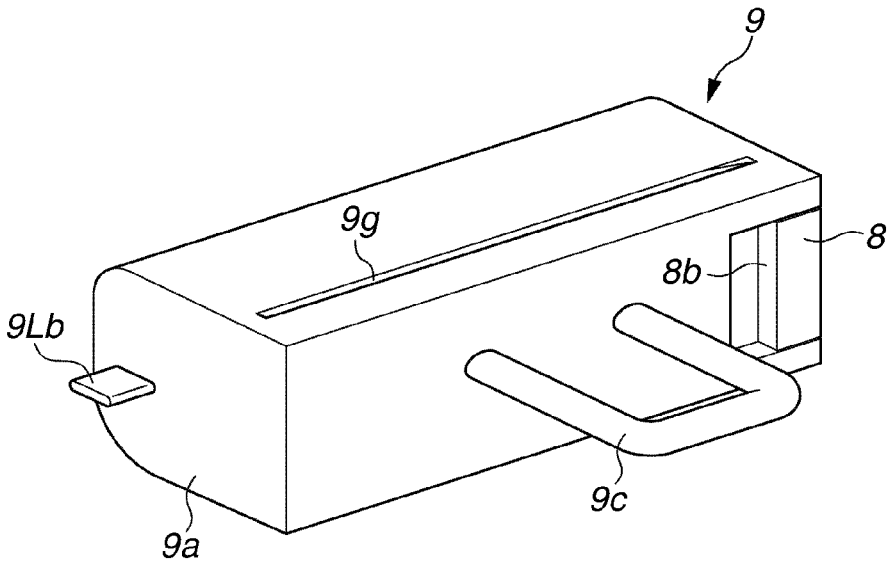
FIG. 3A is a perspective view of a developing cartridge according to the first exemplary embodiment viewed from the left.
Figure 3B:
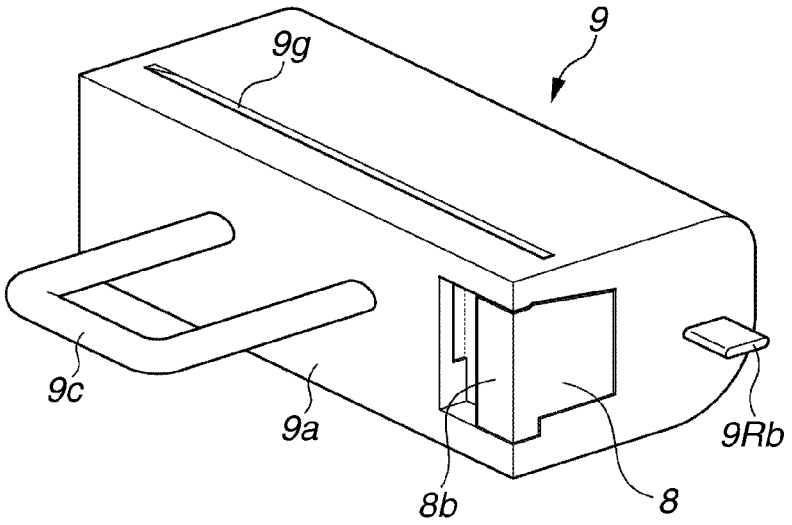
FIG. 3B is a perspective view of the developing cartridge according to the first exemplary embodiment viewed from the right.

FIG. 3A is a perspective view of the developing cartridge 9 viewed from the left side, and FIG. 3B is a perspective view of the developing cartridge 9 viewed from the right side. Guided portions 9Rb and 9Lb are provided respectively on the right-side face and the left-side face of the developing cartridge 9. In the present exemplary embodiment, the guided portions 9Rb and 9Lb, though configured by the curved portion and the flat portion as illustrated in FIGS. 3A and 3B, may also be configured only by the curved portion. The developing cartridge 9 is engaged by placing the right- and left-side guided portions 9Rb and 9Lb on the right-side and left-side guide portions 25R and 25L provided on the developing cartridge attaching/detaching portion 102. Sliding the developing cartridge 9 in this engagement state allows the developing cartridge 9 to be inserted into, or removed from, the attaching/detaching portion 102.

Figure 4:
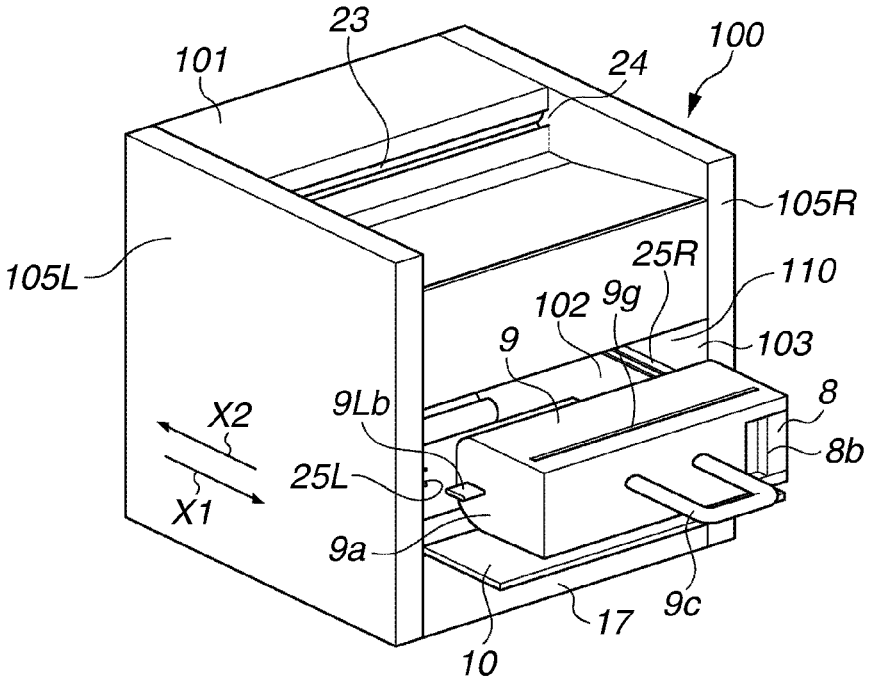
FIG. 4 is a perspective view illustrating how the developing cartridge according to the first exemplary embodiment is removed from, and mounted in, the apparatus main body.

FIG. 4 is a diagram illustrating how the developing cartridge 9 is mounted in, or removed from, the apparatus main body 101. When replacing the developing cartridge 9 or when replacing the toner storage unit 8 with the developing cartridge 9 removed from the apparatus main body 101, the user mounts the developing cartridge 9 in or takes out the developing cartridge 9 from the apparatus main body 101.

First, the user opens the door 10. Then, the developing cartridge attaching/detaching portion 102 is exposed from the opening 103 and the guide portions 25R and 25L can be seen. The user grasps the handle 9*c* of the developing cartridge 9 with the hand, and then engages right- and left-side guided portions 9Rb and 9Lb with the right- and left-side guide portions 25R and 25L of the developing cartridge attaching/detaching portion 102. After that, the user slides the guided portions 9Rb and 9Lb along the guide portions 25R and 25L to insert the developing cartridge 9 into the developing cartridge attaching/detaching portion 102.

The mounting direction (X2 direction) of the developing cartridge 9 is substantially the same as the extension direction of the guide portions 25R and 25L and, therefore, the developing cartridge 9 can be mounted substantially horizontally from the front side of the apparatus main body 101. FIG. 2 is a diagram illustrating that the developing cartridge 9 is inserted into the mounting position and is mounted.

After that, the user closes the door 10. Then, the image forming apparatus 100 is ready for performing the image formation operation.

When the lifetime of the toner storage unit 8 has run out, the user moves the developing cartridge 9 from the position in the apparatus main body 101 to the toner storage unit replacement position 110. The user moves the developing cartridge 9 in the reverse order of the mounting work described above. That is, the user first opens the closed door 10.

When the door 10 is opened, the developing cartridge attaching/detaching portion 102 is opened up and the handle 9*c* of the developing cartridge 9, mounted in the attaching/detaching portion 102, is exposed outside of the opening 103 as illustrated in FIG. 2.

Then, the user grasps the handle 9*c* and slides the guided portions 9Rb and 9Lb along the guide portions 25R and 25L to move the developing cartridge 9 in the direction in which the developing cartridge 9 is moved outside the developing cartridge attaching/detaching portion 102 (developing cartridge take-out direction X1). The take-out direction (X1 direction) of the developing cartridge 9 is the directly opposite direction of the mounting direction (developing cartridge mounting direction X2), and therefore the developing cartridge 9 is removed substantially horizontally from the front of the apparatus main body 101.

Figure 5A:
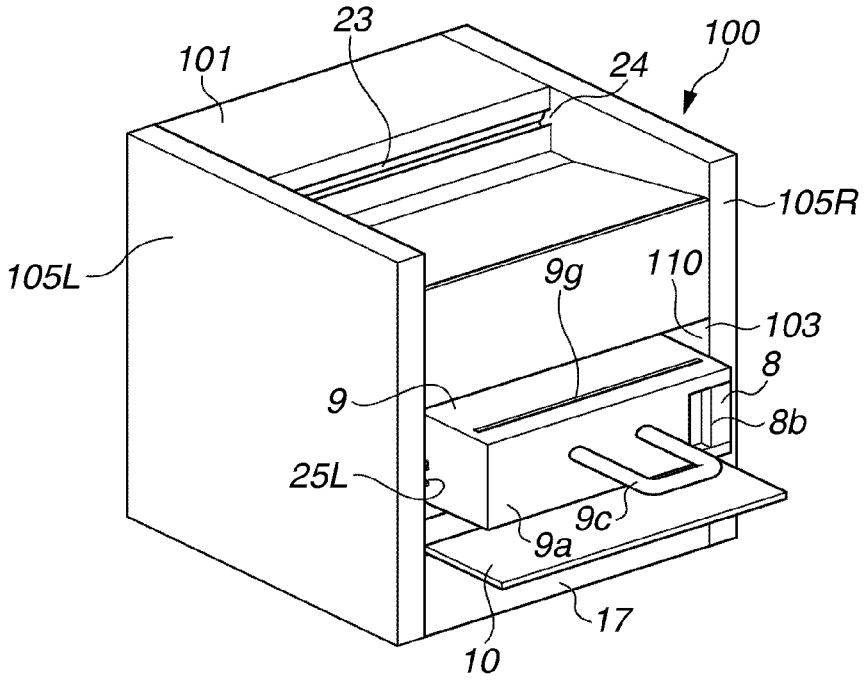
FIG. 5A is a perspective view illustrating a state in which the developing cartridge according to the first exemplary embodiment is moved to a toner storage unit replacement position.
Figure 5B:
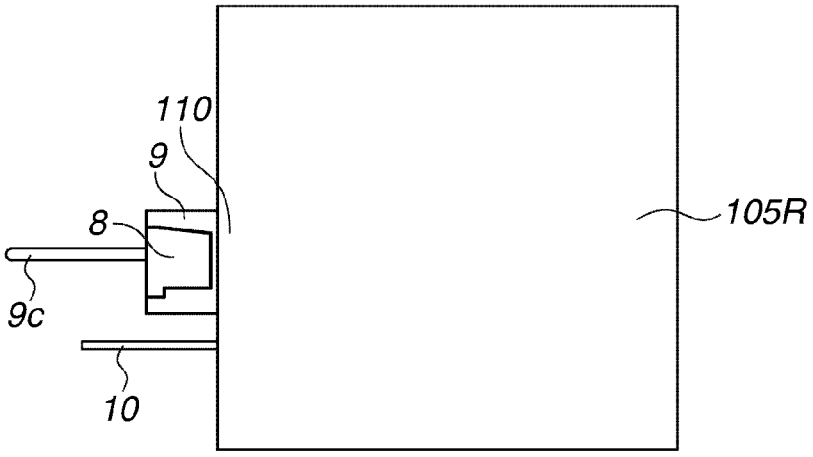
FIG. 5B is a right-side view illustrating a state in which the developing cartridge according to the first exemplary embodiment is moved to the toner storage unit replacement position.

When moved in the take-out direction (X1 direction) for a predetermined length or longer, the developing cartridge 9 reaches the toner storage unit replacement position 110. FIG. 5A is a perspective view illustrating a state in which the developing cartridge 9 is positioned in the toner storage unit replacement position 110. FIG. 5B is a right side view of the state.

The toner storage unit replacement position (replacement position) 110 refers to the position where the toner storage unit 8 can be removed from the developing cartridge 9. In the example illustrated in FIG. 5B, when the developing cartridge 9 is in the toner storage unit replacement position 110, a toner storage unit attaching/detaching portion 9*d* of the developing cartridge 9 can be confirmed visually outside the apparatus main body 101.

The replacement position is different from the mounting position of the developing cartridge 9. The guide portions 25R and 25L are provided in such a manner that the developing cartridge 9 can move between the mounting position and the replacement position.

In the present exemplary embodiment, the attaching/detaching portion 9*d* is exposed outside of the opening 103 of the apparatus main body 101 when the developing cartridge 9 is in the toner storage unit replacement position 110.

In addition to this example, the present exemplary embodiment is applicable also to the configuration in which the attaching/detaching portion 9*d* is provided inside the opening 103 of the apparatus main body 101 and can be confirmed visually from the opening 103 (not illustrated).

This configuration allows the user to replace the toner storage unit 8 with the developing cartridge 9 positioned in the toner storage unit replacement position 110, that is, with the developing cartridge 9 positioned inside the apparatus main body 101.

When the developing cartridge 9 is positioned in the toner storage unit replacement position 110, the guided portions 9Rb and 9Lb of the developing cartridge 9 are supported by the guide portions 25R and 25L. In this state, since at least a part of the weight of the developing cartridge 9 is supported by the guide portions 25R and 25L, the user can replace the toner storage unit 8 easily. After replacing the toner storage unit 8, the user mounts the developing cartridge 9 in the apparatus main body 101 as described above.

Figure 6:
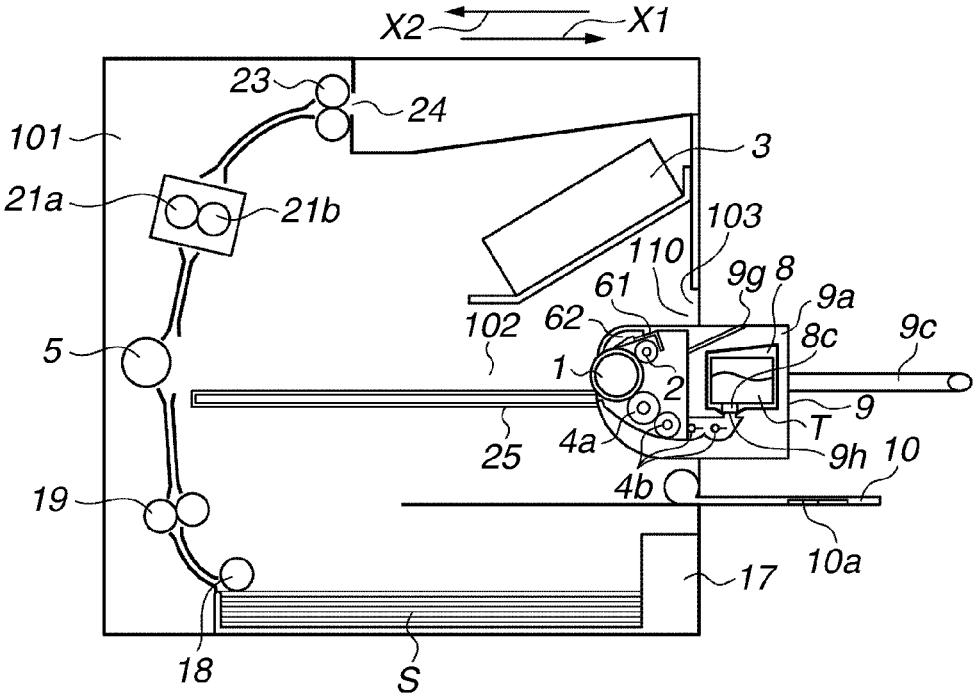
FIG. 6 is a configuration diagram of the developing cartridge according to the first exemplary embodiment when the developing cartridge is positioned in the toner storage unit replacement position.

FIG. 6 is a diagram illustrating the configuration of the developing cartridge 9 when the developing cartridge 9 is in the toner storage unit replacement position 110. The heavy components, such as the drum 1 and the developing roller 4*a*, are provided on the upstream side in the take-out direction (X1 direction) within the main unit 9*a*. Therefore, when the developing cartridge 9 is positioned in the toner storage unit replacement position 110, the center of gravity of the main unit 9*a* is positioned on the downstream side in the mounting direction (X2 direction) with respect to the center of the main unit 9*a*.

As a result, when the main unit 9*a* is positioned in the toner storage unit replacement position 110, the center of gravity of the main unit 9*a* is closer to the inside of the apparatus main body 101 and, therefore, the main unit 9*a* can keep a stable posture.

When the developing cartridge 9 is in the toner storage unit replacement position 110, the drum 1 is not exposed outside of the opening 103 of the apparatus main body 101. Therefore, when the developing cartridge 9 is in the toner storage unit replacement position 110, the user can replace the toner storage unit 8 without exposing the drum 1 externally.

In addition, moving the developing cartridge 9 in the take-out direction (X1 direction) beyond the toner storage unit replacement position 110 causes the guided portions 9Rb and 9Lb to be disengaged from the guide portions 25R and 25L. In this state, the user can take the developing cartridge 9 out of the apparatus main body 101.

In addition, with the developing cartridge 9 removed from the apparatus main body 101, the user can also replace the toner storage unit 8 as when the developing cartridge 9 is in the toner storage unit replacement position 110 in the apparatus main body 101.

As described above, the developing cartridge 9 has the handle 9*c*. The user can grasp the handle 9*c* to move the developing cartridge 9 to the toner storage unit replacement position 110, to take out the developing cartridge 9 outside of the apparatus main body 101, or to mount the developing cartridge 9 in the apparatus main body 101.

Although the process cartridge system, in which the developing cartridge 9 has the drum 1, is described in the present exemplary embodiment, the present exemplary embodiment is applicable also to a developing cartridge system in which the drum 1 is provided in the apparatus main body 101.

The developer T contained in the toner storage unit 8 is consumed as it is used for image formation.

Therefore, a detection unit (not illustrated) for detecting a remaining amount of the developer T in the toner storage unit 8 is provided. The control circuit unit causes the detection unit to compare the detected remaining amount with the pre-set threshold for the toner storage unit lifetime prediction or lifetime warning. When the detected remaining amount becomes smaller than the threshold, the control circuit unit causes the display unit (not illustrated) to display the lifetime prediction or lifetime warning of the toner storage unit 8.

This display prompts the user to prepare a spare for the toner storage unit 8, or to replace the toner storage unit 8, for maintaining the output image quality.

To increase the strength of the parts and to reduce the number of parts, the image forming apparatus 100 in the present exemplary embodiment does not have the door for replacing the toner storage unit 8 but uses the door 10 also, which is provided for replacing the developing cartridge 9, for replacing the toner storage unit 8.

Figure 7A:
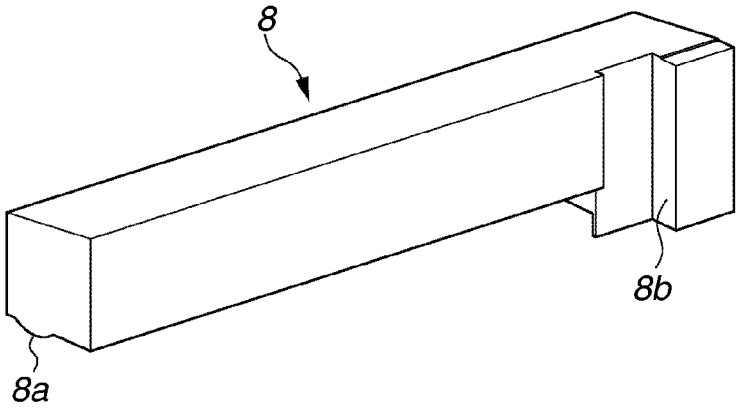
FIG. 7A is a perspective view of the toner storage unit according to the first exemplary embodiment.
Figure 7B:
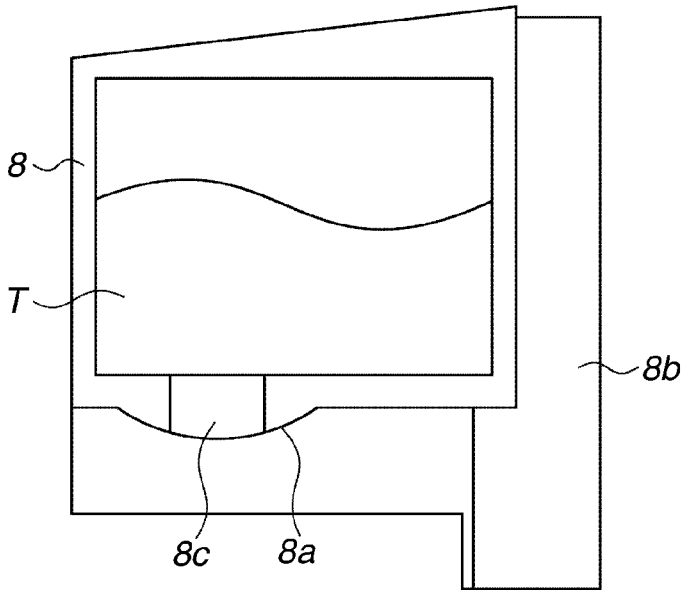
FIG. 7B is a configuration diagram of the toner storage unit according to the first exemplary embodiment.

FIG. 7A is a perspective view of the toner storage unit 8, and FIG. 7B is a configuration diagram of the toner storage unit 8. A toner storage unit guided part 8*a*, corresponding to a toner storage unit guide part 9*e* of the main unit 9*a*, is provided on the bottom of the toner storage unit 8.

On the toner storage unit guided part 8*a* is provided with a toner conveying hole 8*c* connected to a toner supply hole 9*f* to convey the developer T stored in the toner storage unit 8 to the developer conveying unit 4*b*. A toner seal (not illustrated) is provided in the toner conveying hole 8*c*.

Removing the toner seal after mounting the toner storage unit 8 on the toner storage unit attaching/detaching portion 9*d* causes the developer T to be supplied into the main unit 9*a*. A toner storage unit attaching/detaching assist portion 8*b* is provided on the side of the toner storage unit 8 to help the user pull out the toner storage unit 8 from the main unit 9*a*.

Figure 8:
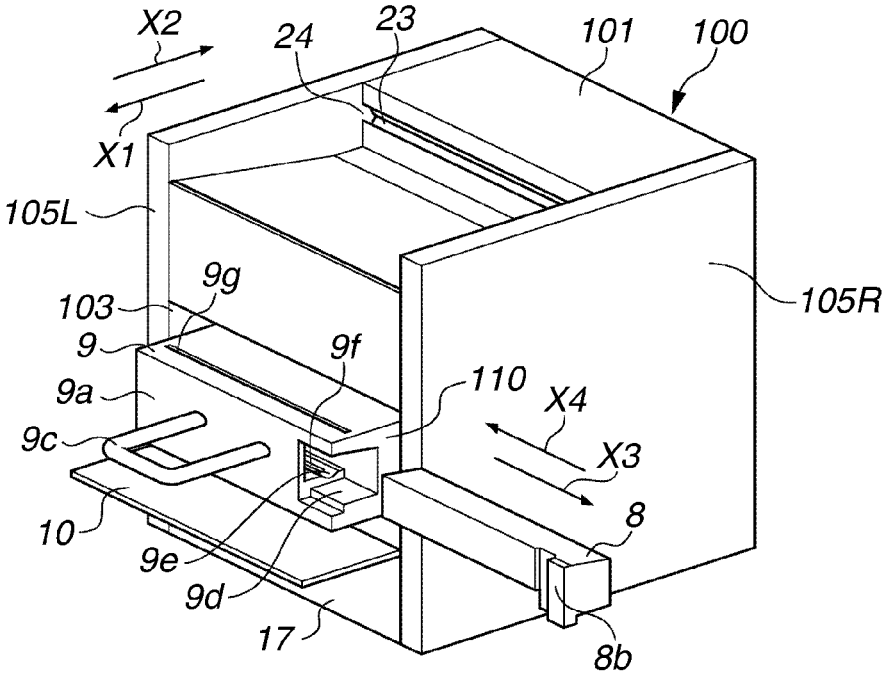
FIG. 8 is a perspective view illustrating a state in which the developing cartridge according to the first exemplary embodiment is moved to the toner storage unit replacement position and the toner storage unit is removed from, or mounted in, the developing cartridge.

FIG. 8 is a perspective view illustrating how the toner storage unit 8 is mounted in, or removed from, the main unit 9*a*. To replace the toner storage unit 8, the user first moves the developing cartridge 9 in the take-out direction (X1 direction) to the toner storage unit replacement position 110. After replacing the toner storage unit 8, the user moves the developing cartridge 9 in the mounting direction (X2 direction) for mounting it.

First, the user opens the door 10. Then, the handle 9*c* of the developing cartridge 9 is seen from the opening 103. The user grasps the handle 9*c* and moves the developing cartridge 9 to the toner storage unit replacement position 110. After the developing cartridge 9 is moved, the attaching/detaching assist portion 8*b* of the toner storage unit 8 can be seen from the opening 103.

The user grasps the attaching/detaching assist portion 8*b* with the hand and slides the toner storage unit 8 into the take-out direction (toner storage unit take-out direction X3). The take-out direction of the toner storage unit 8 is substantially the same as the extension direction of the toner storage unit guide part 9*e*. Therefore, the user can take out the toner storage unit 8 substantially horizontally from the right side of the main body.

After the toner storage unit 8 is removed from the main unit 9*a* to some extent, the user can directly hold the toner storage unit 8 and pull it out.

The take-out direction (X3 direction) of the toner storage unit 8 is different from the developing cartridge take-out direction (X1 direction). In the present exemplary embodiment, the take-out direction (X3 direction) of the toner storage unit 8 is substantially perpendicular to the developing cartridge take-out direction (X1 direction). The use of different take-out directions increases flexibility in designing the take-out configuration of the toner storage unit 8.

After taking out the old toner storage unit 8, the user install a new toner storage unit 8 in the main unit 9*a*. In this state, the main unit 9*a* is positioned in the toner storage unit replacement position 110.

The user installs the toner storage unit 8 by reversing the procedure for taking out the toner storage unit 8 described above. That is, the user holds the toner storage unit 8 and engages the toner storage unit guided part 8*a* with the toner storage unit guide part 9*e* on the main unit 9*a*. The user slides the toner storage unit guided part 8*a* in the installation direction (toner storage unit installation direction X4) along the toner storage unit guide part 9*e* to insert the toner storage unit 8 into the toner storage unit attaching/detaching portion 9*d*.

After the toner storage unit 8 is inserted to some extent, the user can also use the attaching/detaching assist portion 8*b* to continue the insertion. The toner storage unit 8 is inserted substantially horizontally from the right side of the apparatus main body 101. After that, the user grasps the handle 9*c* of the developing cartridge 9 and installs the developing cartridge 9. Then the user closes the door 10.

As described above, when the toner storage unit 8 is replaced, the developing cartridge 9 is positioned in the toner storage unit replacement position 110. In this position, the guided portions 9Rb and 9Lb are supported by the guide portions 25R and 25L as described above. The center of gravity of the main unit 9*a* of the developing cartridge 9 is positioned on the upstream side in the take-out direction with respect to the center of the main unit 9*a*.

Therefore, replacing the toner storage unit 8 with the developing cartridge 9 in the toner storage unit replacement position 110 reduces the possibility that the user will drop the developing cartridge 9 from the apparatus main body 101. In addition, while holding the handle 9*c* of the developing cartridge 9 with a free hand, the user can hold the toner storage unit 8 with another hand to replace it with the main unit 9*a* in a stabler state.

When the user replaces the developing cartridge 9 or when the user takes out the developing cartridge 9 from the apparatus main body 101 to replace the toner storage unit 8, the user takes out the developing cartridge 9 from the apparatus main body 101 as illustrated in FIG. 4.

The user opens the door 10 and then moves the developing cartridge 9 to the toner storage unit replacement position 110 in the same manner as described above. After that, the user moves the developing cartridge 9 further in the take-out direction (X1 direction) to cause the guided portions 9Rb and 9Lb to be disengaged from the developing cartridge attaching/detaching guides 25R and 25L. Then, the user can take out the developing cartridge 9 from the apparatus main body 101.

As described above, this image forming apparatus is configured in such a way that the user opens the door 10 provided for shared use and, with the main unit 9*a* of the developing cartridge 9 inside the apparatus main body 101, and can perform replacement work for replacing the toner storage unit 8.

Therefore, this configuration offers the following two advantages while still ensuring the operability in replacing the toner storage unit 8. First, the number of parts is reduced because the door only for replacing the toner storage unit 8 is not necessary. Second, the strength of the apparatus main body 101 is increased because the holes bored on the side-plate for providing the opening for the door are not necessary.

Next, a second exemplary embodiment of the present invention will be described. In the present exemplary embodiment, the developing cartridge attaching/detaching guides 25 according to the first exemplary embodiment described above are changed to gradient developing cartridge attaching/detaching guides 26. The developing cartridge attaching/detaching guides 25 are the members for guiding the developing cartridge 9 when it is attached or detached. The configuration of the other parts is the same as that in the first exemplary embodiment and, therefore, the same reference numerals are given to the same components and the detailed description thereof will be omitted.

Figure 9:
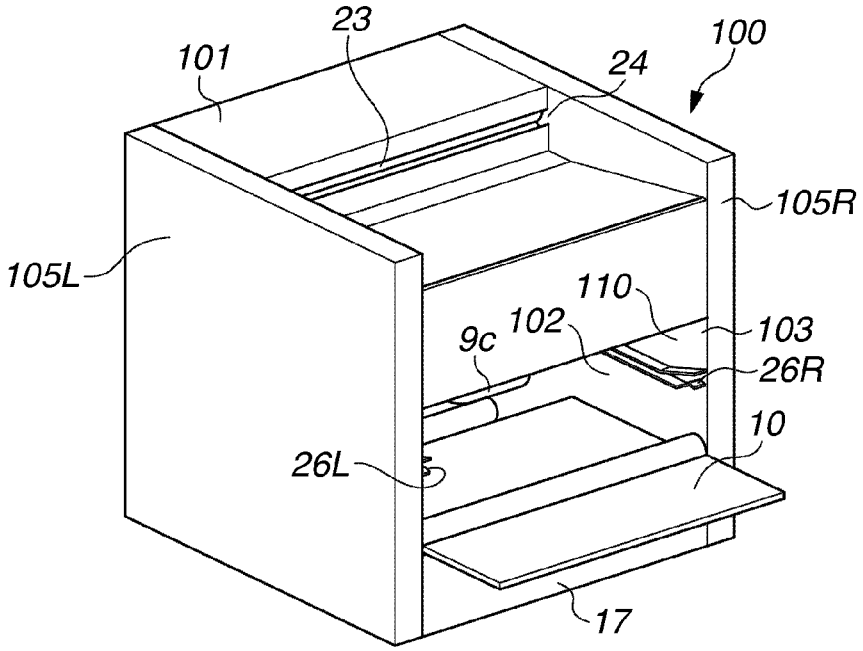
FIG. 9 is a perspective view of an image forming apparatus according to a second exemplary embodiment with the door opened.

FIG. 9 is an external perspective view of an image forming apparatus 100 according to the second exemplary embodiment with the door 10 opened. In the developing cartridge attaching/detaching portion 102, guide portions 26R and 26L, which are opposed to each other, are provided on the internal wall of the frames 105R and 105L for guiding the developing cartridge 9 when it is attached or detached.

Figure 10:
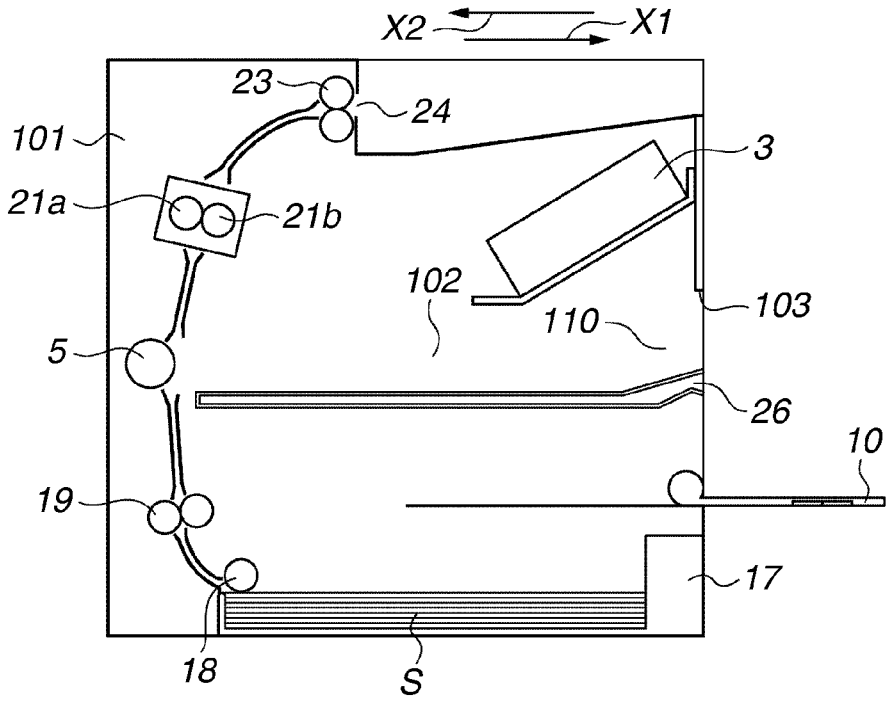
FIG. 10 is a configuration diagram illustrating a state in which the door is opened and the developing cartridge is removed from the apparatus main body according to the second exemplary embodiment.

FIG. 10 is a diagram illustrating a configuration of the apparatus main body 101 according to the second exemplary embodiment with the developing cartridge 9 removed. Each of the guide portions 26R and 26L is composed of the part horizontal to the apparatus main body 101 and the part having a gradient to the take-out direction (X1 direction) of the developing cartridge 9. The angle of this gradient, though not specifically defined, may be an angle to allow the developing cartridge 9 to be removed and mounted smoothly.

The "take-out direction" included in the expression "having a gradient to the take-out direction (X1 direction)" is the direction in which the developing cartridge 9 is moved from the mounting position to the replacement position. In the present exemplary embodiment, the take-out direction is the horizontal direction from the left to the right in FIG. 10.

In the present exemplary embodiment, each of the guide portions 26R and 26L has a part, which has a rising gradient to the take-out direction, on the downstream side of the replacement position in the take-out direction.

Figure 11:
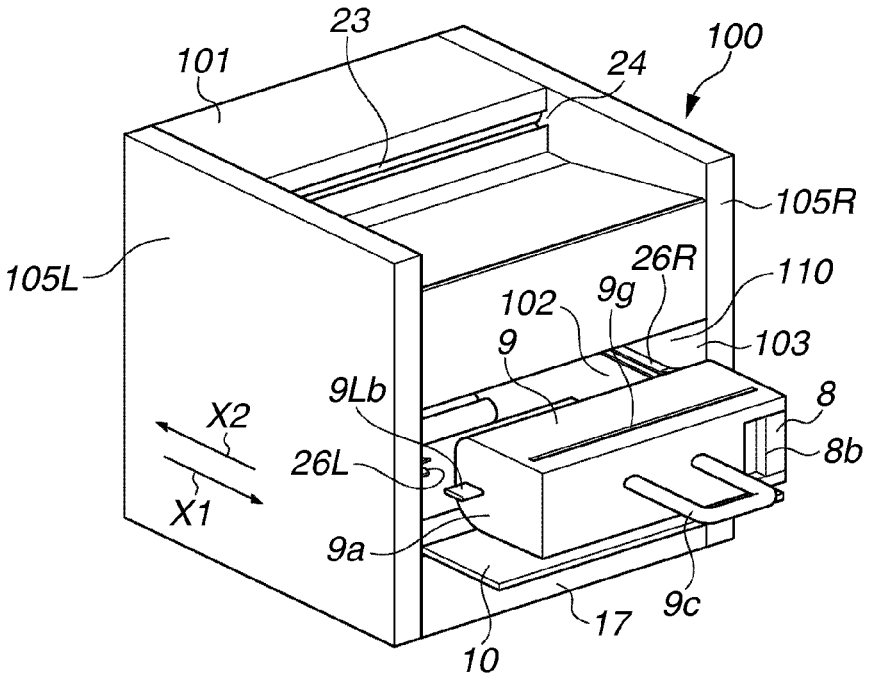
FIG. 11 is a perspective view illustrating a state in which the developing cartridge according to the second exemplary embodiment is removed from, or mounted in, the apparatus main body.

FIG. 11 is a perspective view illustrating how the developing cartridge 9 is mounted in the apparatus main body 101. When replacing the developing cartridge 9 or when replacing the toner storage unit 8 with the developing cartridge 9 removed from the apparatus main body 101, the user moves the developing cartridge 9 in the mounting direction (X2 direction) with respect to the apparatus main body 101 and mounts it.

First, the user opens the door 10. Then, the developing cartridge attaching/detaching portion 102 is exposed from the opening 103 and the guide portions 26R and 26L are seen. The user grasps the handle 9*c* of the developing cartridge 9 with the hand and then engages the developing cartridge guided portions 9Rb and 9Lb with the right- and left-side guide portions 26R and 26L of the developing cartridge attaching/detaching portion 102.

After that, the user slides the guided portions 9Rb and 9Lb in the mounting direction (X2 direction) along the guide portions 26R and 26L to insert the developing cartridge 9 into the developing cartridge attaching/detaching portion 102. Since each of the guide portions 26R and 26L has a shape with a falling gradient to the developing cartridge mounting direction (X2 direction), the first insertion direction of the developing cartridge 9 has a falling gradient to the mounting direction (X2 direction).

When the developing cartridge 9 is further inserted along the guide portions 26R and 26L, the guide portions 26 change in shape from the direction with a falling gradient to the direction similar to the mounting direction (X2 direction). Inserting the developing cartridge 9 along the guide portions 26 further into the inside, the developing cartridge 9 is mounted in the apparatus main body 101 completely.

FIG. 9 is a diagram illustrating a state in which the developing cartridge 9 is mounted in the apparatus main body 101. After that, the user closes the door 10. In this state, the image forming apparatus 100 is ready for performing the image formation operation.

When the lifetime of the toner storage unit 8 has run out, the user moves the developing cartridge 9 from the position in the apparatus main body 101 to the toner storage unit replacement position 110. The user moves the developing cartridge 9 in the reverse order of the mounting work described above. That is, the user first opens the closed door 10. When the door 10 is opened, the developing cartridge attaching/detaching portion 102 is opened up and the external face, on which the handle 9*c* of the developing cartridge 9 mounted in the attaching/detaching portion 102 is provided, is exposed outside of the opening 103 as illustrated in FIG. 9.

Then, the user grasps the handle 9*c* and slides the guided portions 9Rb and 9Lb along the guide portions 26R and 26L to move the developing cartridge 9 in the direction in which the developing cartridge 9 is moved outside the developing cartridge attaching/detaching portion 102 (X1 direction).

When the developing cartridge 9 is moved in the take-out direction (X1 direction) for a predetermined distance, the guide portions 26 change in shape from the direction horizontal to the take-out direction (X1 direction) of the developing cartridge 9 to the direction with a rising gradient. The developing cartridge guided portions 9Rb and 9Lb, which engage with the guide portions 26, are provided on the developing cartridge 9.

The position of the developing cartridge 9, where the guided portions 9Rb and 9Lb come into contact with the above-described part of the guide portions 26 at which the direction changes from the horizontal direction to the direction with a rising gradient, is the toner storage unit replacement position 110.

In this state, the toner storage unit attaching/detaching portion 9*d* is exposed outside of the apparatus main body 101 as in FIG. 5B and FIG. 6 in the first exemplary embodiment to allow the user to replace the toner storage unit 8. After replacing the toner storage unit 8, the user mounts the developing cartridge 9 in the apparatus main body 101 as described above.

Figure 12A:
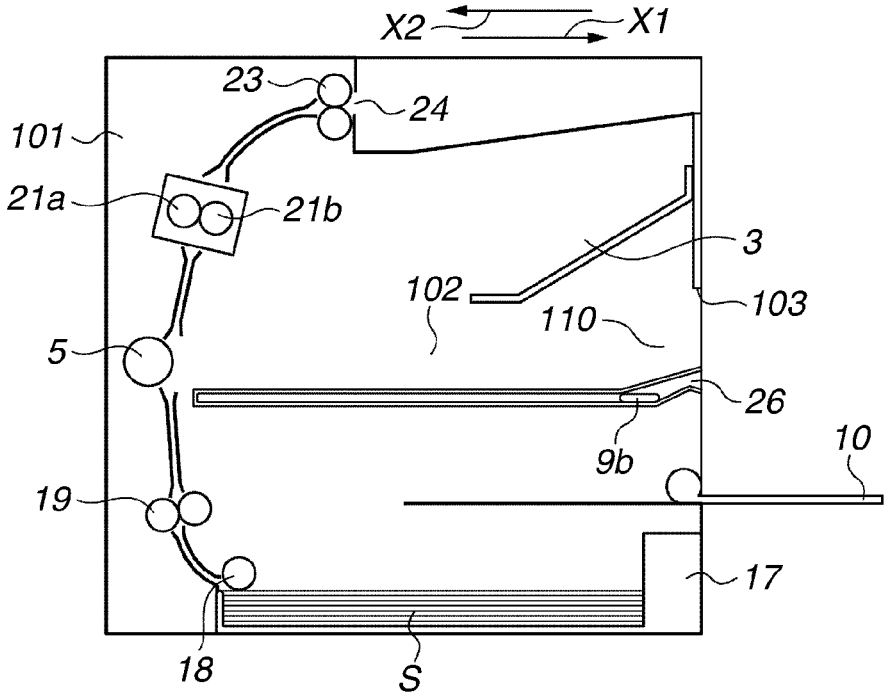
FIG. 12A is a configuration diagram illustrating a guided portion of a main unit and the apparatus main body in a state in which the developing cartridge according to the second exemplary embodiment is moved to the toner storage unit replacement position.
Figure 12B:
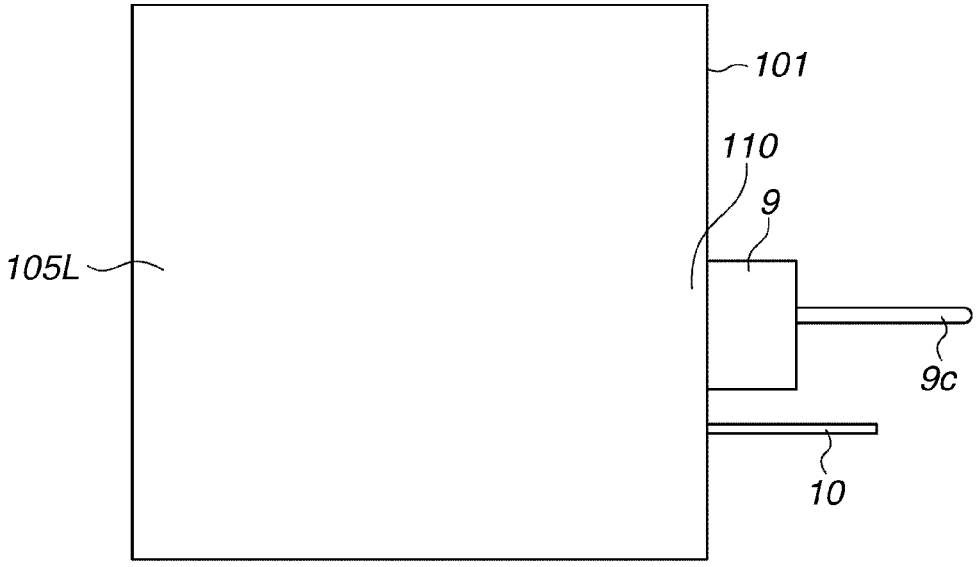
FIG. 12B is a left-side view illustrating a state in which the developing cartridge according to the second exemplary embodiment is moved to the toner storage unit replacement position.

FIG. 12A is a configuration diagram illustrating a positional relationship between the guided portions 9Rb and 9Lb of the developing cartridge 9 and the guide portions 26 when the developing cartridge 9 is in the toner storage unit replacement position 110. FIG. 12B is an external view viewed from the left side. For illustration purposes, FIG. 12A illustrates, not the overall configuration of the developing cartridge 9, but only the guided portions 9Rb and 9Lb.

When the developing cartridge 9 reaches the toner storage unit replacement position 110 when the developing cartridge 9 is moved to the toner storage unit replacement position 110, the guided portions 9Rb and 9Lb come into contact with the guide portions 26 that has a gradient in the take-out direction (X1 direction).

This contact enables the user to recognize that the developing cartridge 9 has reached the toner storage unit replacement position 110. This configuration makes it easy for the user to stop the movement of the developing cartridge 9 in the toner storage unit replacement position 110 without moving the developing cartridge 9 too much.

If the developing cartridge 9 is moved in the take-out direction (X1 direction) too much but if a large part of the guided portions 9Rb and 9Lb comes into contact with the rising gradient of the guide portions 26, the developing cartridge 9 is moved back in the mounting direction (X2 direction) of the developing cartridge 9 by the self-weight. This prevents the developing cartridge 9 from moving in the take-out direction (X1 direction) by itself and thus prevents the developing cartridge 9 from dropping from the apparatus main body 101.

A horizontal part is provided in the guide portions 26 along which the developing cartridge 9 moves from the mounting position thereof to the toner storage unit replacement position 110. This horizontal part reduces the user's load to move the developing cartridge 9 to the toner storage unit replacement position 110.

As illustrated in FIG. 3A according to the first exemplary embodiment, the guided portions 9Rb and 9Lb are configured by the curved portion and the flat portion. In present exemplary embodiment, the flat portion is horizontal in the same direction as the guide direction as illustrated in FIG. 12A.

The longer the length of the flat portion is, the larger the contact area between the guide portions 26 and the guided portions 9Rb and 9Lb of the main unit 9*a* is and the larger the support area is in the toner storage unit replacement position 110. Thus, the user can replace the toner storage unit 8 with the main unit 9*a* in a stabler state.

When the user replaces the developing cartridge 9 or when the user takes out the developing cartridge 9 from the apparatus main body 101 to replace the toner storage unit 8, the user takes out the developing cartridge 9 from the apparatus main body 101.

The user opens the door 10, and then moves the developing cartridge 9 to the toner storage unit replacement position 110 in the same manner as described above. After that, when the user further moves the developing cartridge 9 from the toner storage unit replacement position 110 in the take-out direction, the guide portions 26 change in shape from horizontal direction to a rising gradient to the take-out direction (X1 direction). The user continues moving the developing cartridge 9 along the guide portions 26.

When the user further continues to move the developing cartridge 9, the guided portions 9Rb and 9Lb are disengaged from the guide portions 26 in the developing cartridge attaching/detaching portion 102. Then, the user can take out the developing cartridge 9 from the apparatus main body 101.

Although the process cartridge system, in which the main unit 9*a* of the developing cartridge 9 has the drum 1, is described in the present exemplary embodiment, the present exemplary embodiment is also applicable to a developing cartridge system in which the drum 1 is provided in the apparatus main body 101.

When the toner storage unit 8 is replaced, the developing cartridge 9 is positioned in the toner storage unit replacement position 110. In this position, the guided portions 9Rb and 9Lb of the developing cartridge 9 are in contact with the guide portions 26 in two different surfaces as illustrated in FIG. 12A. One is the horizontal surface and the other is the surface with a rising gradient to the take-out direction (X1 direction).

In this state, even if an external force or a vibration is applied to the main unit 9*a* when the toner storage unit 8 is replaced, the gradient is formed in the guide portions 26 in the direction in which the main unit 9*a* does not easily drop from the apparatus main body 101 (take-out direction (X1 direction)), and this gradient makes it difficult for the main unit 9*a* to move. Therefore, this configuration reduces the possibility that the main unit 9*a* of the developing cartridge 9 will drop when the toner storage unit 8 is replaced.

Next, a third exemplary embodiment of the present invention will be described. The present exemplary embodiment is different from the first exemplary embodiment in that developing cartridge latching portions 27R and 27L are provided on the frames 105R and 105L, and in that developing cartridge latched portions 9Rf and 9Lf are provided on the right side and the left side of the developing cartridge 9. The configuration of other parts is the same as that in the first exemplary embodiment and, therefore, the same reference numerals are given to the same components and the detailed description thereof will be omitted.

Figure 13:
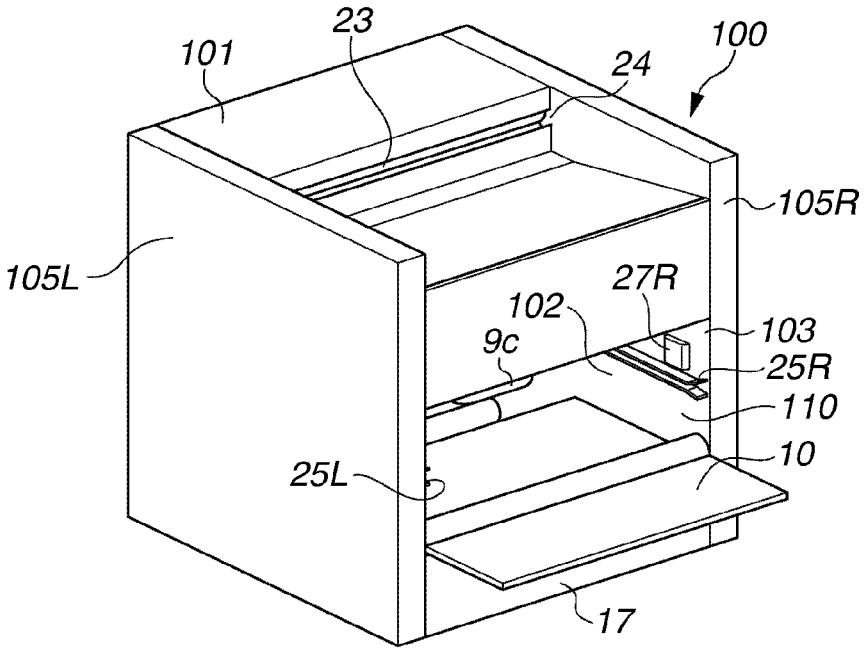
FIG. 13 is a perspective view of the image forming apparatus according to a third exemplary embodiment with the door opened.

FIG. 13 is an external perspective view of an image forming apparatus 100 with the door 10 opened according the third exemplary embodiment. On the internal walls of the frames 105R and 105L in the developing cartridge attaching/detaching portion 102, the latching portions 27R and 27L are provided for latching the developing cartridge 9 for use when the toner storage unit 8 is replaced in the toner storage unit replacement position 110.

Figure 14A:
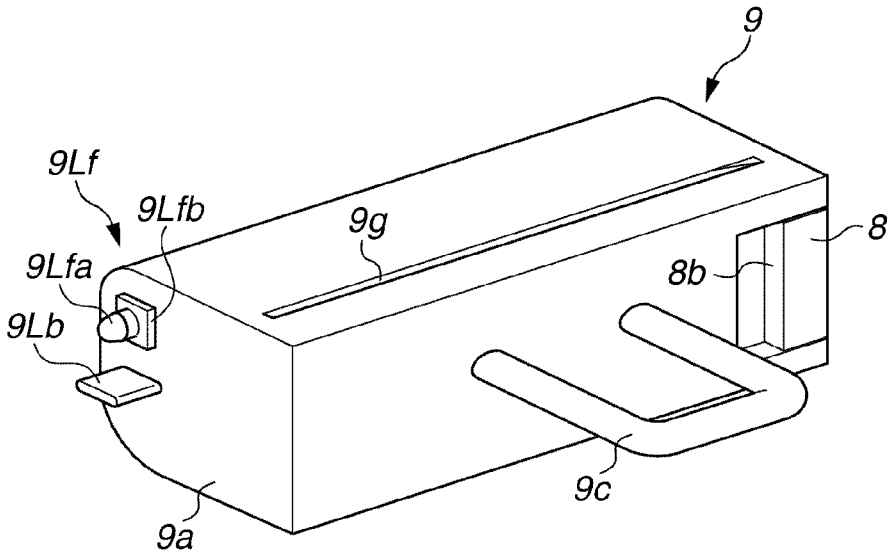
FIG. 14A is a perspective view of a developing cartridge according to the third exemplary embodiment viewed from the left.
Figure 14B:
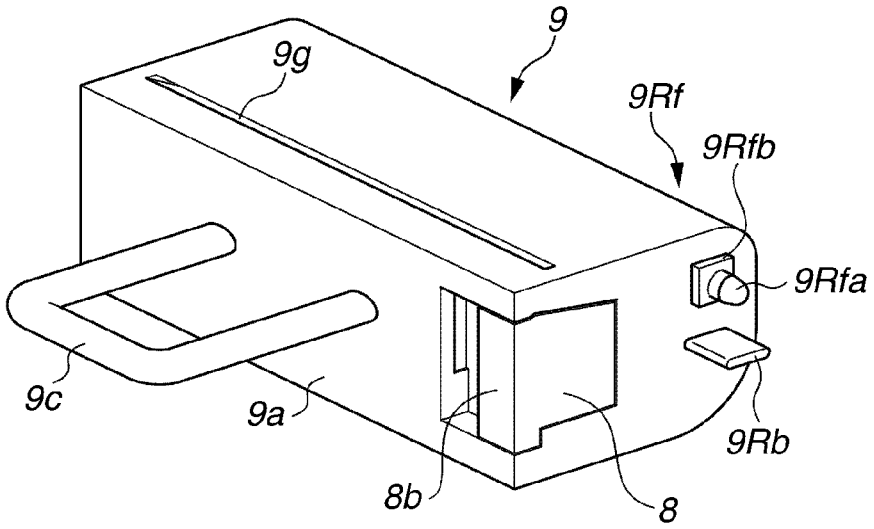
FIG. 14B is a perspective view of the developing cartridge in the third exemplary embodiment viewed from the right.

FIG. 14A is a perspective view of the developing cartridge 9 viewed from the left side, and FIG. 14B is a perspective view of the developing cartridge 9 viewed from the right side.

The latched portions 9Rf and 9Lf are provided on the right side and the left side of the main unit 9*a* of the developing cartridge 9 respectively. The main unit 9*a* is engaged by placing the right and left developing cartridge latched portions 9Rf and 9Lf on the right and left latching portions 27R and 27L in the developing cartridge attaching/detaching portion 102 respectively. The position, in which the developing cartridge latched portions 9Rf and 9Lf are placed on the latching portions 27R and 27L, is the toner storage unit replacement position 110.

In this state, the toner storage unit attaching/detaching portion 9*d* of the main unit 9*a* is exposed outside of the apparatus main body 101 as illustrated in FIG. 5B and FIG. 6 according to the first exemplary embodiment. The user can replace the toner storage unit 8 in this state.

Figure 15A:
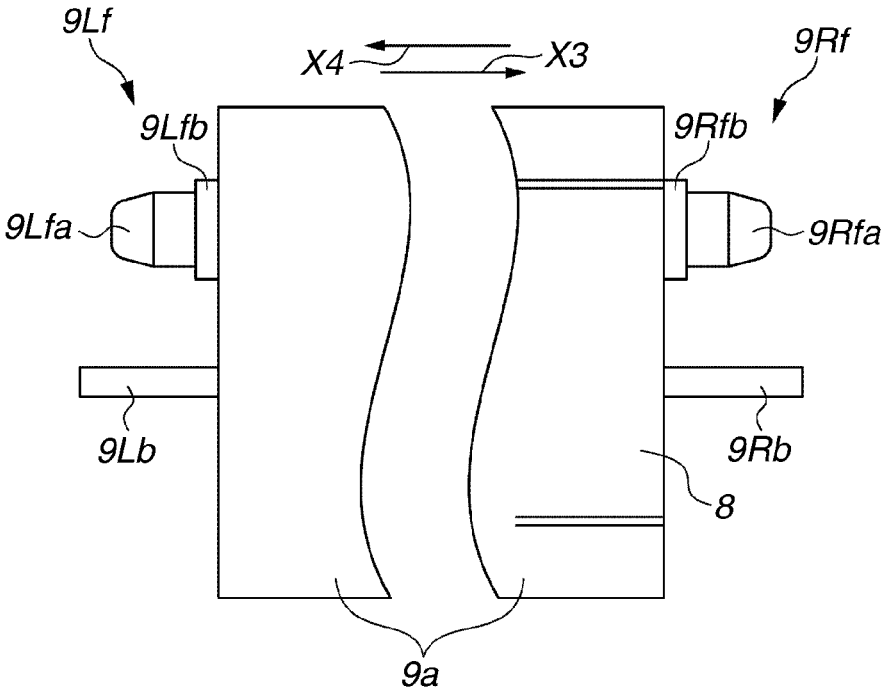
FIG. 15A is a front view of the developing cartridge according to the third exemplary embodiment when an external force is not applied to latched portions of the developing cartridge.
Figure 15B:
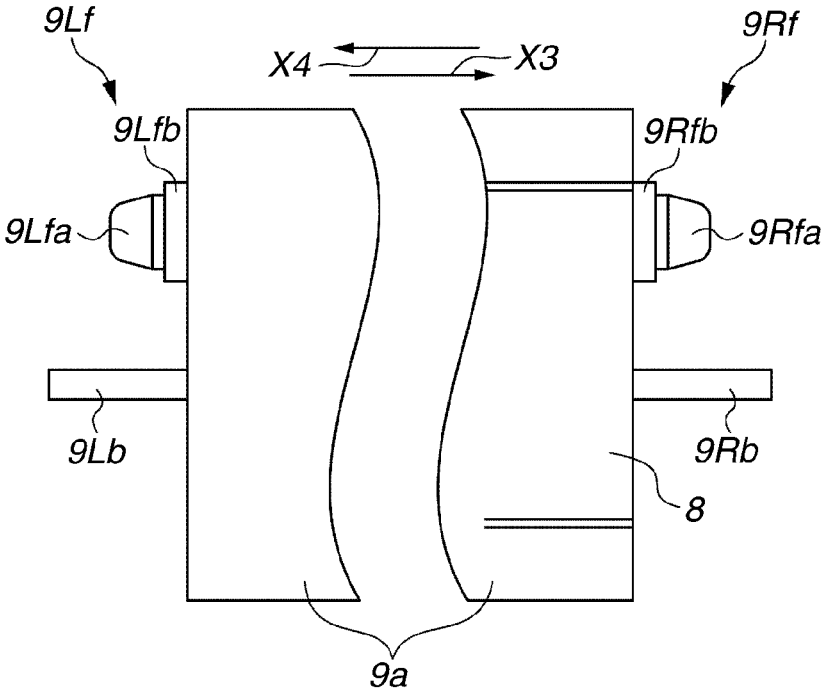
FIG. 15B is a front view of the developing cartridge according to the third exemplary embodiment when an external force is applied to the latched portions of the developing cartridge.

The latching is described in detail. FIG. 15A is a front view of the latched portions 9Rf and 9Lf when the latched portions 9Rf and 9Lf have the original length (not retracted). FIG. 15B is a front view of the latched portions 9Rf and 9Lf when the latched portions 9Rf and 9Lf are retracted. The latched portion 9Rf is configured by a retraction portion 9Rfa and a non-retraction portion 9Rfb, and the latched portion 9Lf by a retraction portion 91Rfa and a non-retraction portion 91*fb*. Each of the retraction portions 9Rfa and 9Lfa internally has a compression spring that retracts in the X4 direction or X3 direction respectively. Usually, the compression spring is biased in the state illustrated in FIG. 15A.

The retraction portions 9Rfa and 9Lfa are configured in such a way that, when an external force is applied thereto in the retraction direction along the axis line direction of the retraction portions 9Rfa and 9Lfa, the retraction portions 9Rfa and 9Lfa are retracted a predetermined amount. For example, when the retraction portion 9Lfa provided on the left side of the main unit 9*a* comes into contact with the latching portion 27L, an external force is generated in the X3 direction and, therefore, the retraction portion 9Lfa is retracted in the X3 direction. The retraction portion 9Rfa provided on the right side of the main unit 9*a* is retracted in the X4 direction because an external force is generated in the X4 direction. When the external force acting on the retraction portions 9Rfa and 9Lfa is removed, the retraction portions 9Rfa and 9Lfa return to the original state.

Figure 16A:
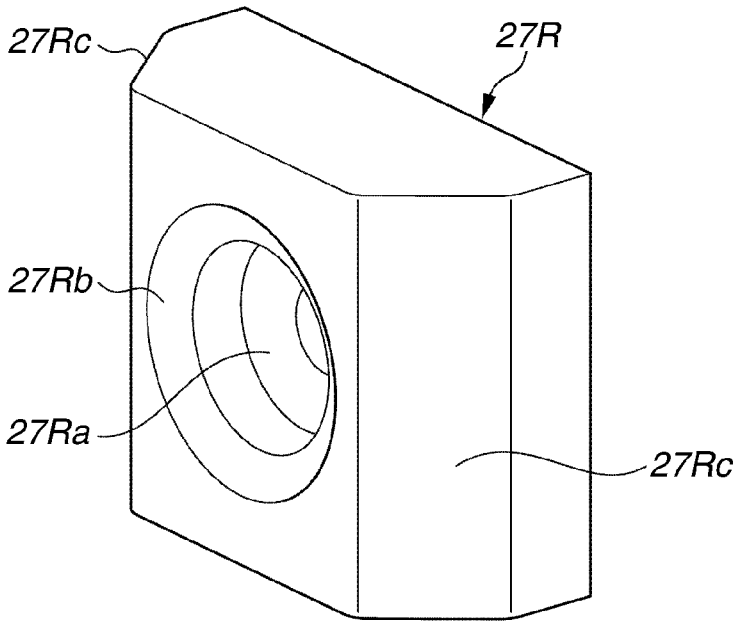
FIG. 16A is a perspective view of the developing cartridge latching portion on a right-side according to the third exemplary embodiment.
Figure 16B:
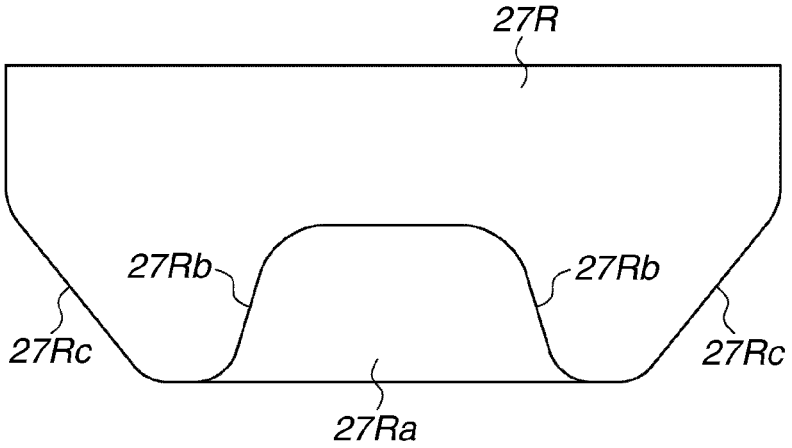
FIG. 16B is a horizontal cross section across the center of the developing cartridge latching portion on the right side according to the third exemplary embodiment.

FIG. 16A is an enlarged perspective view of the latching portion 27R provided on the right frame 105R of the apparatus main body 101. FIG. 16B is a cross section across the center of the latching portion 27R viewed from top.

The latching portion 27R has an inside surface 27Ra in the center thereof. The inside surface 27Ra has a concave shape formed according to the shape of the latched portion 9Rf to accommodate thereof. An inside contact surface 27Rb and an outside contact surface 27Rc of the latching portion 27R, with which the latched portion 9Rf comes into contact when the developing cartridge 9 is moved, have a smooth shape so that the retraction portion 9Rfa of the latched portion 9Rf comes into contact with those contact surfaces at a moderate angle. The configuration and the function of the latching portion 27L provided on the left frame 105L are the same as those of the latching portion 27R and, therefore, the description thereof is omitted.

Figure 17:
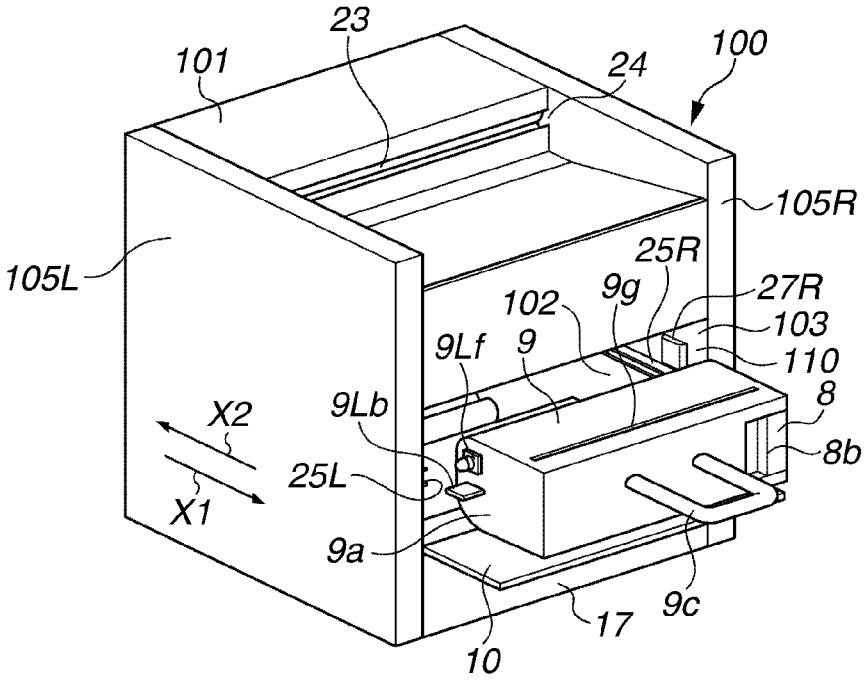
FIG. 17 is a perspective view illustrating a state in which the developing cartridge according to the third exemplary embodiment is removed from, or mounted in, the apparatus main body.

FIG. 17 is a perspective view illustrating how the developing cartridge 9 is mounted in the apparatus main body 101. When replacing the developing cartridge 9 or when replacing the toner storage unit 8 with the developing cartridge 9 removed from the apparatus main body 101, the user mounts the developing cartridge 9 in the developing cartridge attaching/detaching portion 102 of the apparatus main body 101.

First, the user opens the door 10. Then, the developing cartridge attaching/detaching portion 102 is exposed and the guide portions 25R and 25L can be seen. The user grasps the handle 9*c* of the developing cartridge 9 with the hand, and then engages the guided portions 9Rb and 9Lb of the main unit 9*a* with the right- and left-side guide portions 25R and 25L of the developing cartridge attaching/detaching portion 102.

After that, the user slides the guided portions 9Rb and 9Lb along the guide portions 25R and 25L to insert the developing cartridge 9 into the developing cartridge attaching/detaching portion 102. The insertion direction (X2 direction) of the developing cartridge 9 is substantially the horizontal direction from the front of the apparatus main body 101.

Moving the developing cartridge 9 a short distance in the mounting direction (X2 direction) brings the leading edges of the retraction portions 9Rfa and 9Lfa of the latched portions 9Rf and 9Lf into contact with the outside contact surfaces 27Rc and 27Lc of the developing cartridge latching portions 27R and 27L, causing the retraction portions 9Rfa and 9Lfa to be retracted.

Moving the developing cartridge 9 further in the mounting direction (X2 direction) brings the leading edges of the retraction portions 9Rfa and 9Lfa into contact with the inside contact surfaces 27Rb and 27Lb. After passing the inside contact surfaces 27Rb and 27Lb, the developing cartridge 9 reaches the inside surfaces 27Ra and 27La, each of which is the concave portion of the latching portions 27R and 27L.

Since the retraction portions 9Rfa and 9Lfa are not in contact with the contact surfaces in this state, the length of the retraction portions 9Rfa and 9Lfa becomes the original length. After that, moving the developing cartridge 9 in the mounting direction brings the leading edges of the retraction portions 9Rfa and 9Lfa of the latched portions 9Rf and 9Lf into contact with the inside contact surfaces 27Rb and 27Lb of the latching portions 27R and 27L, causing the retraction portions 9Rfa and 9Lfa to be retracted.

Moving the developing cartridge 9 further in the mounting direction (X2 direction) brings the leading edges of the retraction portions 9Rfa and 9Lfa of the latched portions 9Rf and 9Lf into contact with the outside contact surfaces 27Rc and 27Lc and, after that, the leading edges pass them. After passing the outside contact surfaces 27Rc and 27Lc, the latching portions 27R and 27L are not in contact with the latched portions 9Rf and 9Lf, and the length of the latched portions 9Rf and 9Lf becomes the original length.

When the user moves the developing cartridge 9 continuously in the mounting direction (X2 direction) and the guided portions 9Rb and 9Lb of the developing cartridge 9 reach the end of the guide portions 25R and 25L, the mounting of the developing cartridge 9 is completed.

FIG. 13 is a diagram illustrating a state in which the developing cartridge 9 is mounted in the apparatus main body 101. After that, the user closes the door 10. Then, the image forming apparatus 100 is ready for performing the image formation operation.

When the lifetime of the toner storage unit 8 has run out, the user moves the developing cartridge 9 from the position in the apparatus main body 101 to the toner storage unit replacement position 110. The user moves the developing cartridge 9 in the reverse order of the mounting work described above. That is, the user first opens the closed door 10.

Figure 18:
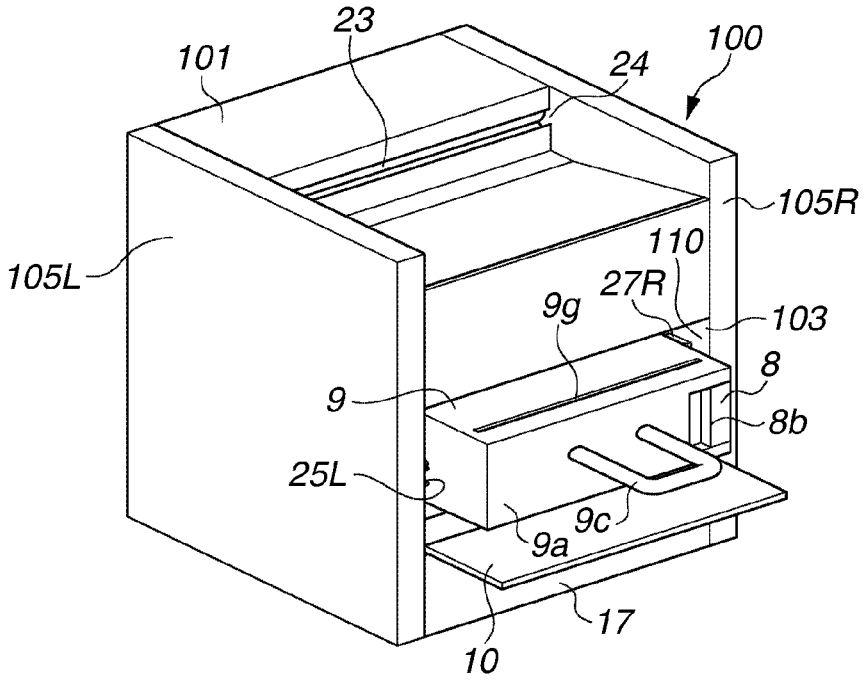
FIG. 18 is a perspective view illustrating a state in which the developing cartridge according to the third exemplary embodiment is moved to the toner storage unit replacement position.

When the door 10 is opened, the developing cartridge attaching/detaching portion 102 is opened up and the external face on which the handle 9*c* of the developing cartridge 9, mounted in the attaching/detaching portion 102, is exposed outside of the opening 103 as illustrated in FIG. 18.

Then, the user grasps the handle 9*c* and slides the guided portions 9Rb and 9Lb along the guide portions 25R and 25L to move the developing cartridge 9 in the direction in which the developing cartridge 9 is moved outside the developing cartridge attaching/detaching portion 102 (X1 direction). The take-out direction (X1 direction) of the developing cartridge 9 is directly the opposite direction of the mounting direction (X2 direction), and therefore the developing cartridge 9 is removed substantially horizontally from the front of the apparatus main body 101.

Moving the developing cartridge 9 in the take-out direction (X1 direction) brings the leading edges of the retraction portions 9Rfa and 9Lfa of the latched portions 9Rf and 9Lf into contact with the outside contact surfaces 27Rc and 27Lc of the latching portions 27R and 27L, causing the retraction portions 9Rfa and 9Lfa to be retracted.

Moving the developing cartridge 9 further in the take-out direction (X1 direction) brings the leading edges of the retraction portions 9Rfa and 9Lfa into contact with the inside contact surfaces 27Rb and 27Lb. After passing the inside contact surfaces 27Rb and 27Lb, the developing cartridge 9 reaches the inside surfaces 27Ra and 27La, each of which is the concave portion of the latching portions 27R and 27L.

Since the retraction portions 9Rfa and 9Lfa are not in contact with the contact surfaces in this state, the length of the retraction portions 9Rfa and 9Lfa becomes the original length. FIG. 18 is a perspective view illustrating a state in which the developing cartridge 9 is positioned in the toner storage unit replacement position 110. In this state, the toner storage unit attaching/detaching portion 9*d* is exposed outside of the apparatus main body 101 similarly to the state illustrated in FIG. 5B in the first exemplary embodiment to allow the user to replace the toner storage unit 8.

After replacing the toner storage unit 8, the user mounts the developing cartridge 9 in the apparatus main body 101 as described above.

When the user replaces the developing cartridge 9 or when the user takes out the developing cartridge 9 from the apparatus main body 101 to replace the toner storage unit 8, the user takes out the developing cartridge 9 from the apparatus main body 101.

The user opens the door 10 and moves the developing cartridge 9 to the toner storage unit replacement position 110 in the same manner as described above. In this state, moving the developing cartridge 9 into the take-out direction (X1 direction) brings the leading edges of the retraction portions 9Rfa and 9Lfa of the latched portions 9Rf and 9Lf into contact with the inside contact surfaces 27Rb and 27Lb of the latching portions 27R and 27L, causing the retraction portions 9Rfa and 9Lfa to be retracted.

Moving the developing cartridge 9 further in the take-out direction (X1 direction) brings the leading edges of the retraction portions 9Rfa and 9Lfa of the latched portions 9Rf and 9Lf into contact with the outside contact surfaces 27Rc and 27Lc. After passing the outside contact surfaces 27Rc and 27Lc, the latching portions 27R and 27L are not in contact with the latched portions 9Rf and 9Lf.

Since the latched portions 9Rf and 9Lf are not in contact with the contact surfaces in this state, the length of the latched portions 9Rf and 9Lf becomes the original length. When the user moves the developing cartridge 9 continuously in the take-out direction, the guided portions 9Rb and 9Lb of the developing cartridge 9 are disengaged from the guide portions 25R and 25L, and the take-out of the developing cartridge 9 from the apparatus main body 101 is completed.

Although the process cartridge system, in which the developing cartridge 9 has the drum 1, is described in the present exemplary embodiment, the present exemplary embodiment is applicable also to a developing cartridge system in which the drum 1 is provided in the apparatus main body 101.

When the toner storage unit 8 is replaced, the developing cartridge 9 is positioned in the toner storage unit replacement position 110 and the latched portion 9*f* stays in the inside surface 27*a* of the latching portion 27. Herein, the retraction portion 9*fa* of the latched portion 9*f* is configured in such away that the retraction portion 9*fa* is retracted only when the user uses the handle 9*c* to move the developing cartridge 9 in the mounting direction (X2 direction) at mounting time, or in the take-out direction (X1 direction) at take-out time, with a force sufficient to move it.

Therefore, though an external force or a vibration may be transmitted to the main unit 9*a* when the toner storage unit 8 is replaced, the configuration, in which the main unit 9*a* is difficult to move, reduces the possibility that the main unit 9*a* will drop from the apparatus main body 101.

Unlike the configuration in the first exemplary embodiment and the second exemplary embodiment, the configuration in the third exemplary embodiment physically prevents the main unit 9*a* from being moved by the self-weight when the toner storage unit 8 is replaced, thus reducing the possibility that the main unit 9*a* of the developing cartridge 9 will drop from the apparatus main body 101.

In the present exemplary embodiment, the latching portions 27 are provided in the apparatus main body 101 and the latched portions 9Rf and 9Lf are provided on the developing cartridge 9. However, the reversed configuration is also possible in which the latching portions 27 are provided on the developing cartridge 9 and the latched portions 9Rf and 9Lf are provided in the apparatus main body 101.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-153628 filed Jul. 12, 2011, which is hereby incorporated by reference herein in its entirety.

What is claimed is:

1. An image forming apparatus comprising:

an apparatus main body; and a developing cartridge removable mounted in the apparatus main body, wherein the developing cartridge comprises:

a main unit, wherein the main unit includes a developer bearing member for forming a toner image, and a toner storage unit removably mounted in the main unit and being held in the main unit during forming of an image, wherein the toner storage unit is configured to supply a developer to the developer bearing member, wherein the apparatus main body comprises:

a guide portion configured to guide a guided portion of the developing cartridge so that the developing cartridge can move between a mounting position and a replacement position, wherein the mounting position is a position in which the developing cartridge forms an image, and wherein the replacement position is a position downstream of the mounting position in a direction the developing cartridge is removed and at which position the toner storage unit can be removed from the main unit, wherein when the developing cartridge is inserted along the guide portion a predetermined amount, the guide portion changes in shape from the direction with a falling gradient to a direction similar to the mounting direction for mounting the developing cartridge in the apparatus main body completely, wherein the developing cartridge can be removed from the apparatus main body via an opening provided on the apparatus main body, and wherein, in a state in which the guided portion is supported by the guide portion in the replacement position, the toner storage unit can be removed from the developing cartridge in a direction the toner storage unit is removed, which is different from the direction the developing cartridge is removed, wherein the toner storage unit can be removed from the apparatus main body via the opening.

2. The image forming apparatus according to claim 1, wherein in the replacement position, a mounting portion of the toner storage unit is exposed outside of the opening of the apparatus main body.

3. The image forming apparatus according to claim 2, wherein, when the developing cartridge is in the replacement position, the developer bearing member is located upstream of the mounting portion of the toner storage unit in the direction the developing cartridge is removed.

4. The image forming apparatus according to claim 2, wherein the main unit includes a photosensitive member and, when the developing cartridge is in the replacement position, the photosensitive member is located upstream of the mounting portion of the toner storage unit in the direction the developing cartridge is removed.

5. The image forming apparatus according to claim 4, wherein, when the developing cartridge is in the replacement position, the photosensitive member is located upstream of the opening in the direction the developing cartridge is removed.

6. The image forming apparatus according to claim 1, wherein the guide portion includes a rising gradient portion downstream of the replacement position in the direction the developing cartridge is removed.

7. The image forming apparatus according to claim 1, wherein the guide portion includes a horizontal portion between the mounting position and the replacement position.

8. The image forming apparatus according to claim 1, wherein the guided portion includes a flat portion, wherein the flat portion contacts a flat portion of the guide portion.

9. The image forming apparatus according to claim 1, wherein the apparatus main body includes a latching member on which the developing cartridge is latched in the replacement position, and wherein the developing cartridge includes a latched unit that engages with the latching member.

10. The image forming apparatus according to claim 1, wherein the direction the toner storage unit is removed is approximately perpendicular to the direction the developing cartridge is removed.

11. The image forming apparatus according to claim 1, wherein the guided portion is in an edge side of the main unit with respect to a direction where the toner storage unit is removed.

12. An image forming apparatus comprising:

an apparatus main body; and a developing cartridge removable mounted in the apparatus main body, wherein the developing cartridge comprises:

a main unit, wherein the main unit includes, a developer bearing member for forming a toner image, and a toner storage unit removably mounted in the main unit and being held in the main unit during forming of an image, wherein the toner storage unit is configured to supply a developer to the developer bearing member, and a first guide portion to guide mounting and removing of the toner storage unit, wherein the apparatus main body comprises:

a second guide portion configured to guide a guided portion of the developing cartridge so that the developing cartridge can move between a mounting position and a replacement position, wherein the mounting position is a position in which the developing cartridge forms an image, and wherein the replacement position is a position downstream of the mounting position in a direction the developing cartridge is removed and at which position the toner storage unit can be removed from the main unit, wherein the developing cartridge can be removed from the apparatus main body via an opening provided on the apparatus main body, wherein, in a state in which the guided portion is supported by the guide portion in the replacement position, the toner storage unit can be removed from the developing cartridge in a direction the toner storage unit is removed, which is different from the direction the developing cartridge is removed, wherein the toner storage unit can be removed from the apparatus main body via the opening, and wherein the second guide portion guides in a direction different than the first guide portion.

13. The image forming apparatus according to claim 12, wherein a first guide direction of the first guide portion intersects a second guide direction of the second guide portion, with respect to a horizontal surface.

14. The image forming apparatus according to claim 12, wherein a first guide direction of the first guide portion is perpendicular to a second guide direction of the second guide portion, with respect to a horizontal surface.

15. An image forming apparatus comprising:

an apparatus main body; and a developing cartridge removable mounted in the apparatus main body, wherein the developing cartridge comprises:

a main unit, wherein the main unit includes, a first handle located at a downstream side of a replacement position in the take-out direction of the main unit, a developer bearing member for forming a toner image, and a toner storage unit removably mounted in the main unit and being held in the main unit during forming of an image, wherein the toner storage unit is configured to supply a developer to the developer bearing member, and wherein the toner storage unit includes a second handle located at a downstream side of a replacement position in the take-out direction of the toner storage unit, and wherein the apparatus main body comprises:

a second guide portion configured to guide a guided portion of the developing cartridge so that the developing cartridge can move between a mounting position and a replacement position, wherein the mounting position is a position in which the developing cartridge forms an image, and wherein the replacement position is a position downstream of the mounting position in a direction the developing cartridge is removed and at which position the toner storage unit can be removed from the main unit, wherein the developing cartridge can be removed from the apparatus main body via an opening provided on the apparatus main body, wherein, in a state in which the guided portion is supported by the guide portion in the replacement position, the toner storage unit can be removed from the developing cartridge in a direction the toner storage unit is removed, which is different from the direction the developing cartridge is removed, wherein the toner storage unit can be removed from the apparatus main body via the opening.

16. The image forming apparatus according to claim 15, wherein the first handle and the second handle are located upstream of a mounting direction of the developing cartridge.

17. The image forming apparatus according to claim 15, wherein the second handle is located at a downstream side of a mounting direction and removing direction of the toner storage unit.

18. The image forming apparatus according to claim 15, wherein the toner storage unit is held in the main unit during forming of an image.

* * * * *